US007387095B2

(12) United States Patent
Babbitt et al.

(10) Patent No.: US 7,387,095 B2
(45) Date of Patent: Jun. 17, 2008

(54) HYDRAULIC VALVE ACTUATION SYSTEMS AND METHODS TO PROVIDE VARIABLE LIFT FOR ONE OR MORE ENGINE AIR VALVES

(75) Inventors: Guy Robert Babbitt, Colorado Springs, CO (US); Miguel Angelo Raimao, Manitou Springs, CO (US); Charles Conrad Klose, Plainfield, IL (US); Jeffrey Allen Rogers, Woodland Park, CO (US); Oded Eddie Sturman, Woodland Park, CO (US)

(73) Assignee: Sturman Industries, Inc., Woodland Park, CO (US)

( * ) Notice: Subject to any disclaimer, the term of this patent is extended or adjusted under 35 U.S.C. 154(b) by 0 days.

(21) Appl. No.: 11/102,192

(22) Filed: Apr. 8, 2005

(65) Prior Publication Data

US 2005/0263116 A1 Dec. 1, 2005

Related U.S. Application Data

(60) Provisional application No. 60/560,561, filed on Apr. 8, 2004.

(51) Int. Cl.
*F01L 9/02* (2006.01)

(52) U.S. Cl. ..... 123/90.12; 123/90.15; 123/90.24; 251/285; 251/284

(58) Field of Classification Search ..... 123/90.12; 251/284, 285, 288
See application file for complete search history.

(56) References Cited

U.S. PATENT DOCUMENTS 3,209,737 A 10/1965 Omotehara et al.

(Continued)

FOREIGN PATENT DOCUMENTS

WO WO-02/46582 A2 6/2002

OTHER PUBLICATIONS

Misovec, Kathleen M., et al., "Digital Valve Technology Applied to the Control of an Hydraulic Valve Actuator", SAE Technical Paper 1999-01-0825, Mar. 1-4, 1999, International Congress and Exposition, Detroit, Michigan.

(Continued)

*Primary Examiner*—Thomas Denion
*Assistant Examiner*—Kyle M. Riddle
(74) *Attorney, Agent, or Firm*—Blakely Sokoloff Taylor & Zafman LLP

(57) ABSTRACT

Hydraulic valve actuation systems and methods to provide variable lift for one or more engine air valves by way of a variable position hard stop. Various embodiments are disclosed, including embodiments controlling lift by providing a choice of two different fixed stops, three different fixed stops, stops continuously variable throughout a range of lifts, and a fixed stop and stops continuously variable throughout a range of lifts. The valves controlled by a variable position hard stop may be a single engine intake or exhaust valve, or multiple valves of any number, and of either intake or exhaust valves or both, or of one intake or one exhaust valve for one or more cylinders in engines having more than one intake or exhaust valve per cylinder. Dashpot deceleration of engine valve velocity on opening to the hard stop and on engine valve closure is disclosed, as are other aspects and embodiments of the invention.

36 Claims, 12 Drawing Sheets

U.S. PATENT DOCUMENTS 4,821,689 A 4/1989 Tittizer et al.
5,048,489 A * 9/1991 Fischer et al. ..... 123/467
5,241,935 A 9/1993 Beck et al.
5,463,987 A * 11/1995 Cukovich ..... 123/90.15
5,598,871 A 2/1997 Sturman et al.
5,638,781 A 6/1997 Sturman
5,640,987 A 6/1997 Sturman
5,713,315 A * 2/1998 Jyoutaki et al. ..... 123/90.12
5,713,316 A 2/1998 Sturman
5,829,396 A 11/1998 Sturman
5,960,753 A 10/1999 Sturman
5,970,956 A 10/1999 Sturman
6,109,284 A 8/2000 Johnson et al.
6,148,778 A 11/2000 Sturman
6,173,685 B1 1/2001 Sturman
6,308,690 B1 10/2001 Sturman
6,340,009 B1 * 1/2002 Boecking ..... 123/90.15
6,360,728 B1 3/2002 Sturman
6,374,784 B1 4/2002 Tischer et al.
6,415,749 B1 7/2002 Sturman et al.
6,505,584 B2 1/2003 Lou
6,557,506 B2 5/2003 Sturman
6,575,126 B2 6/2003 Sturman
6,584,885 B2 7/2003 Lou
6,668,773 B2 * 12/2003 Holtman et al. ..... 123/90.12
6,739,293 B2 5/2004 Turner et al.
6,886,511 B1 5/2005 Tong et al.

OTHER PUBLICATIONS

Tai, Chun, et al., "Using Camless Valvetrain for Air Hybrid Optimization", SAE Technical Paper 2003-01-0038, Mar. 2003, SAE 2003 World Congress & Exhibition, Detroit, Michigan.
Klose, Charles, "Sturman HVA-4D System", SAE 2004, Mar. 8-11, 2004.

* cited by examiner

HYDRAULIC VALVE ACTUATION SYSTEMS AND METHODS TO PROVIDE VARIABLE LIFT FOR ONE OR MORE ENGINE AIR VALVES

CROSS-REFERENCE TO RELATED APPLICATION

This application claims the benefit of U.S. Provisional Patent Application No. 60/560,561 filed Apr. 8, 2004.

BACKGROUND OF THE INVENTION

1. Field of the Invention

The present invention relates to the field of piston engines.

2. Prior Art

Historically, piston engines have used mechanically actuated poppet type intake and exhaust valves operated by way of an engine driven camshaft. While such systems are in a high state of development and usually provide reliable performance for the life of the engine, they have the disadvantage of providing a fixed relationship between crankshaft angle and valve position. Accordingly, the timing for valve opening and closing, the valve lift obtained, etc., are predetermined and fixed throughout the operating range of the engine, thus providing a substantial engine performance compromise under most engine operating conditions.

More recently, considerable work has been done in the development of alternate engine valve actuation systems, generally with a goal of allowing the varying of valve opening and closing crankshaft angle with varying engine operating conditions, and in some cases, of varying the valve lift based on engine operating conditions. One such alternate actuation system comprises hydraulic valve actuation using a spring return, a hydraulic return, or a combination of both. Generally, such valve actuation systems use either a single stage or a two-stage electrically controlled valving system for operation of the hydraulic actuator, the valving system being operative between three states, the first coupling the hydraulic actuator to a source of hydraulic fluid under pressure, the second blocking hydraulic fluid communication to or from the hydraulic engine valve actuator, and the third coupling the hydraulic engine valve actuator to a low pressure drain or vent. Thus engine valve lift may be controlled by controlling the timing between initiating valve opening by coupling the hydraulic engine valve actuator to the source of fluid under pressure and the blocking of the flow of hydraulic fluid to or from the hydraulic engine valve actuator. This, in theory, provides the desired result, though in practice may not provide the accuracy and uniformity in valve lift desired for smooth engine operation under all conditions.

Systems are also known for controlling the valving based on actual measurement of valve position. This has certain advantages, but also adds to the complexity of the system. In engines with multiple intake and/or exhaust valves per cylinder, a common engine valve actuator for the multiple valves of each type would need to be used, as typically the control would be common for economic reasons, and separate actuators may not track each other that well. Also, the control would need to be closed loop in real time for each actuator, preferably with a self adapting capability based on feedback of the actual lift obtained on the last engine cycle, making the control algorithm complicated and limiting the accuracy achieved by the limited speed of the control valving.

DETAILED DESCRIPTION OF THE PREFERRED EMBODIMENTS

Figure 1:
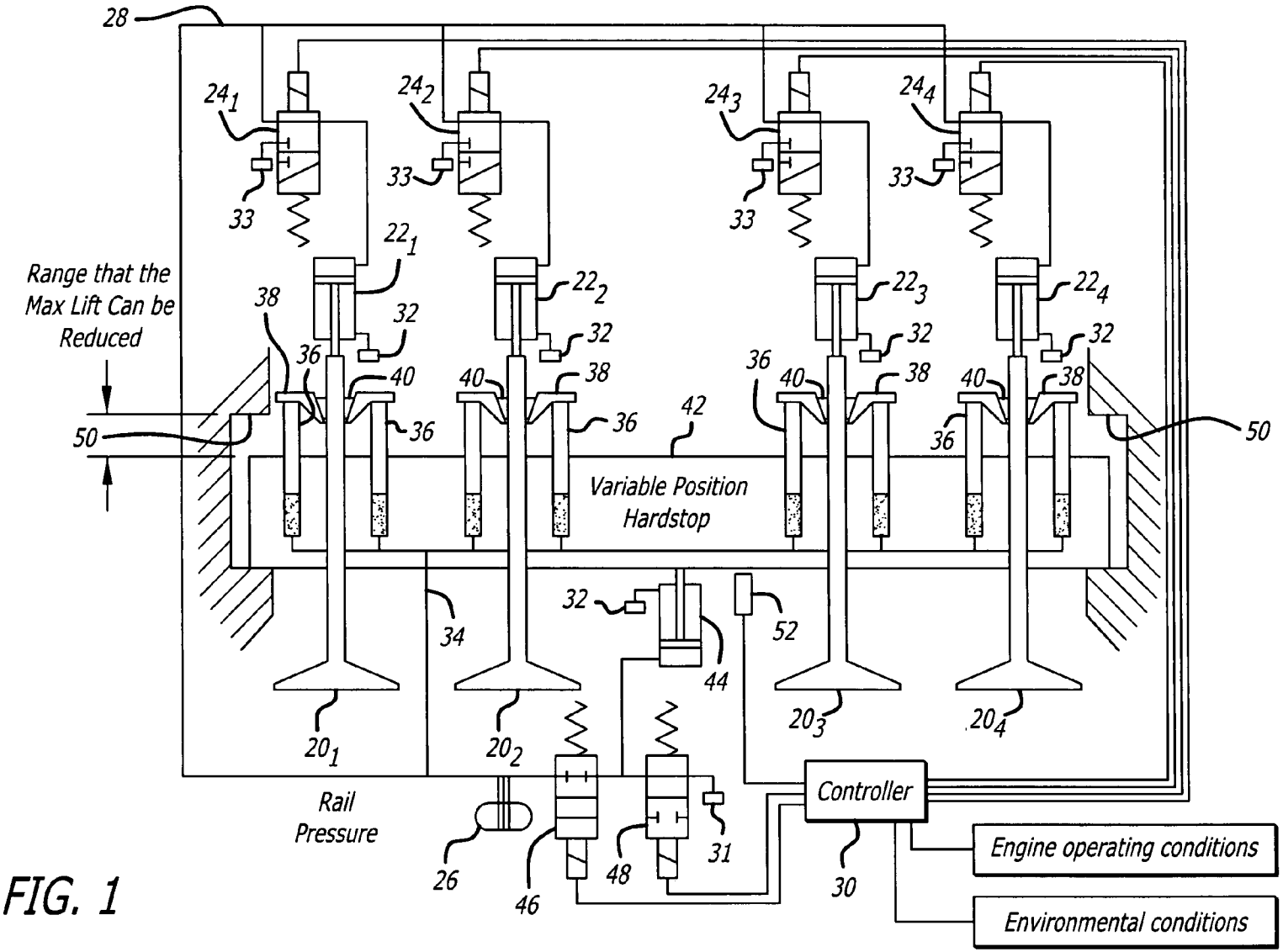
FIG. 1 is a schematic diagram of a preferred embodiment of the present invention.

First referring to FIG. 1, a schematic diagram of a preferred embodiment of the present invention may be seen. This schematic provides a good overview of an embodiment of the present invention, though as shall subsequently be seen, various details of preferred forms of various elements of FIG. 1 providing specific implementations and additional capabilities and features are not explicitly shown in FIG. 1.

FIG. 1 illustrates four engine valves $\mathbf{20}_1$, $\mathbf{20}_2$, $\mathbf{20}_3$ and $\mathbf{20}_4$, each actuated by a respective hydraulic actuator $\mathbf{22}_1$, $\mathbf{22}_2$, $\mathbf{22}_3$ and $\mathbf{22}_4$, in turn controlled by three-way valves $\mathbf{24}_1$, $\mathbf{24}_2$, $\mathbf{24}_3$ and $\mathbf{24}_4$. The control valves 24 in the preferred embodiment are coupled to a high pressure rail 26 through line 28, the three-way control valves in the embodiment illustrated being single solenoid spring return spool valves controlled by controller 30, though other types of valves may be used as desired, such as double solenoid magnetically latching or non-latching, single solenoid hydraulic return or poppet valves. Also, each three-way valve may be replaced by two two-way valves if desired. The control valves 24 couple the hydraulic actuators 22, either to the high pressure rail 26,28 or to vents or backpressure rail 33, responsive to the controller 30. The high pressure rail 26 is also coupled to line 34, pressurizing the regions under return pins 36, urging the return pins 36 upward against members 38, which in turn urge the respective engine valves 20 upward through keepers 40 to the closed position. The combined areas of return pins 36 pressing upward against any one member 38 is less than the area of the respective hydraulic actuator 22, so that when the respective control valve 24 couples the respective hydraulic actuator to the high pressure rail 26,28, the respective engine valve 20 and pins 36 will be forced downward to the engine valve open position, though when the control valve couples the hydraulic actuator 22 to the vent or back pressure 32, the respective pins 36 will force the engine valve back to its closed position.

Also shown in FIG. 1 is a variable position hard stop 42, shown in its lowermost position corresponding to the maximum allowable valve lift, though moveable upward by hydraulic actuator 44 controlled by two electrically operated two-way valves 46 and 48, valve 46 being controlled by controller 30 to controllably couple hydraulic actuator 44 to the high pressure rail 26, or to block such coupling, and valve 48 being controlled by controller 30 to controllably couple hydraulic actuator 44 to vent or back pressure 31, or block such coupling. In the preferred embodiment, valves 46 and 48 are single solenoid spring return valves, though like control valves 24, may be any of many other various configurations and valve types, or could be a single three position, three-way valve. As a further alternative, valves 46 and 48 could be a single two position three way valve or two two-way valves to selectively move the variable position hard stop 42 to either of its extreme positions. This allows a selection between valve lifts, yet eliminates the need for a position sensor.

It will subsequently be seen that while a separate hard stop is provided for each valve at its full lift relative to the variable position hard stop 42, that hard stop is reached just before pins 36 would otherwise bottom out in the cylinders in which they operate. Thus by moving variable position hard stop 42 upward, the lift of the engine valves 20 is uniformly reduced, providing a minimum lift when variable position hard stop 42 contacts stops 50. Note in the embodiment of FIG. 1, the lift of a plurality of engine valves is simultaneously controlled by controlling the position of variable position hard stop 42 through hydraulic actuator 44. In that regard, in some embodiments, the area of hydraulic actuator 44 exceeds the collective area of pins 36 so that the force of hydraulic actuator 44 may provide an upward force on variable position hard stop 42 exceeding the downward force thereon because of the rail pressure under pins 36. In other embodiments, the variable position hard stop 42 is biased upward or downward hydraulically or by springs. Note, however, that the total hydraulic energy used in moving variable position hard stop 42 is still relatively low, as variable position hard stop 42 does not move like an engine valve itself moves, but rather generally only moves as engine operating conditions change, and then not necessarily through its entire allowed motion. In that regard, in the preferred embodiment a position sensor 52 is used to provide position information on variable position hard stop 42 to the controller 30 so that variable position hard stop 42 may be moved to vary engine valve lift between lift extremes without having to go to either extreme as a reference to avoid a drift in time of actual variable position hard stop 42 position in comparison to the intended variable position hard stop 42 position. Alternatively, however, position sensor 52 need not be used, though in such situations it may be desirable to assure taking variable position hard stop 42 to at least one extreme position periodically for reestablishing a reference point from which further motion is projected.

In the embodiment of FIG. 1, separate control valves $\mathbf{24}_1$ through $\mathbf{24}_4$ are used, each to control a separate engine valve $\mathbf{20}_1$ through $\mathbf{20}_4$. Typically in such an embodiment, the engine valves $\mathbf{20}_1$ through $\mathbf{20}_4$ would be the intake valves or the exhaust valves of four separate cylinders, such as by way of example, in a 4-cylinder engine or a 4-cylinder bank of an 8-cylinder engine. Alternatively, the four engine valves might represent an intake and an exhaust valve for each of two cylinders of an engine, though it may be preferred to be able to separately control the lift of intake and exhaust valves. As a further alternative, the four engine valves shown in FIG. 1 might be two intake valves and two exhaust valves in a single cylinder of an engine. Alternatively, as may be seen in FIG. 2, one may use a single control valve $\mathbf{24}_1$ to control two engine valves $\mathbf{20}_1$ and $\mathbf{20}_2$, such as two intake valves, and to use a second control valve $\mathbf{24}_3$ to control the two exhaust valves $\mathbf{20}_3$ and $\mathbf{20}_4$. Other embodiments for multi-cylinder engines may be configured, by way of example, for one variable position hard stop to control the lift of all intake valves and another separately controlled variable position hard stop to control the lift of all exhaust valves. As a still further variation, for multi-cylinder engines having dual intake and exhaust valves per cylinder, one variable position hard stop may control the lift of all exhaust valves, another variable position hard stop may control the lift of one intake valve for all cylinders and a third variable position hard stop may control the lift of the other intake valve for all cylinders.

Figure 2:
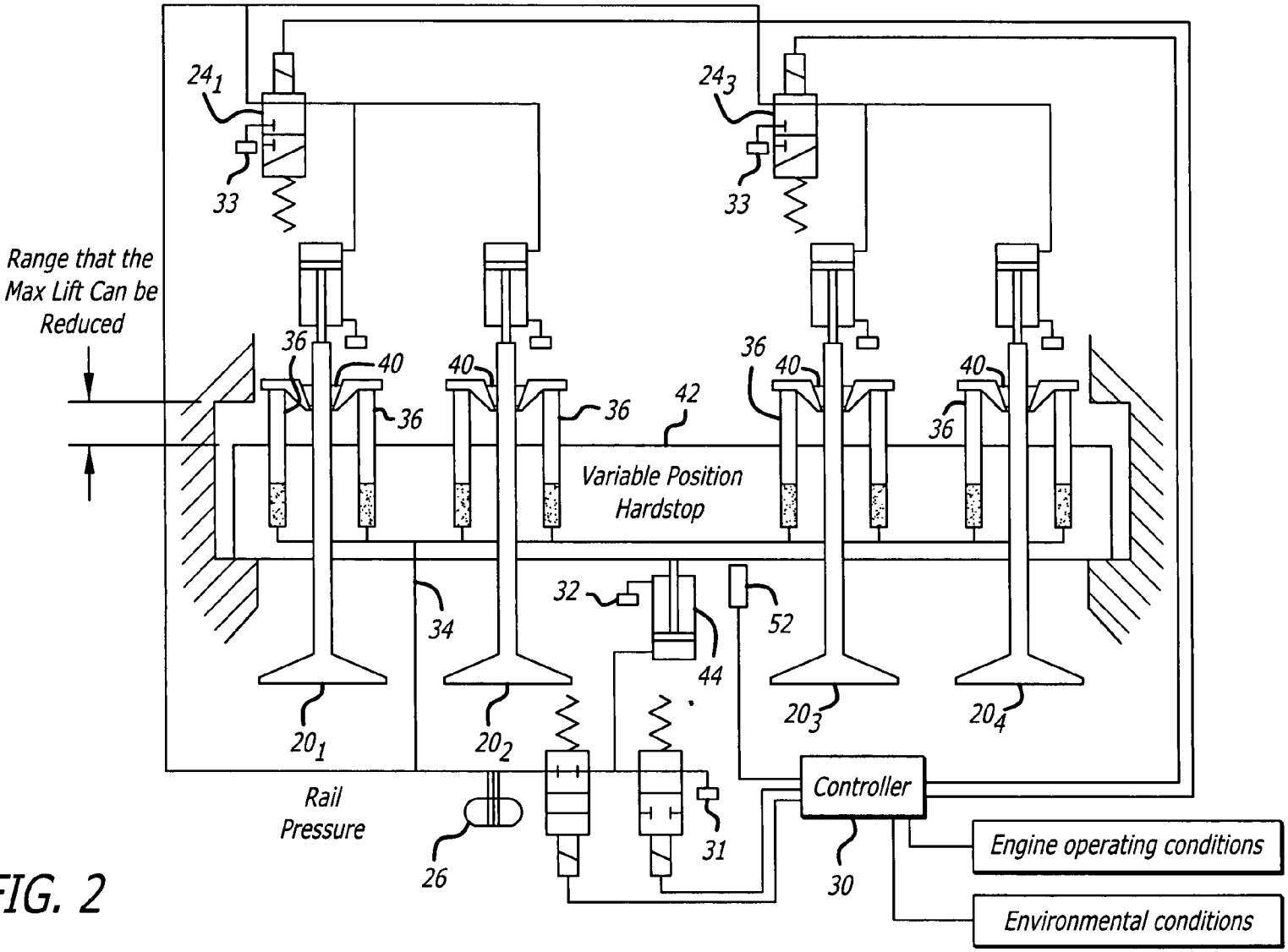
FIG. 2 is a schematic diagram of an alternate embodiment of the present invention.

Note that the control valves 24 in FIGS. 1 and 2 are preferably three-way valves, though as stated before, two two-way valves may be used as desired. Similarly, while valves 46 and 48 are two-way valves in a preferred embodiment, a single three position, three-way valve could be used if desired.

One aspect of the present invention not shown in detail in FIGS. 1 and 2, but preferably incorporated therein, is unidirectional dashpot damping, not only on engine valve closure, but also on the approach of full engine valve lift, defined by the position of variable position hard stop 42 (FIGS. 1 and 2). The dashpot damping decelerates each engine valve as it approaches full lift, wherever set, and as the engine valve approaches the engine valve closed position. This dashpot damping is unidirectional in that it is effective only for deceleration purposes, and is effectively bypassed when the engine valve is accelerated from either position toward the opposite position via a check valve in the hydraulic return.

Figure 3:
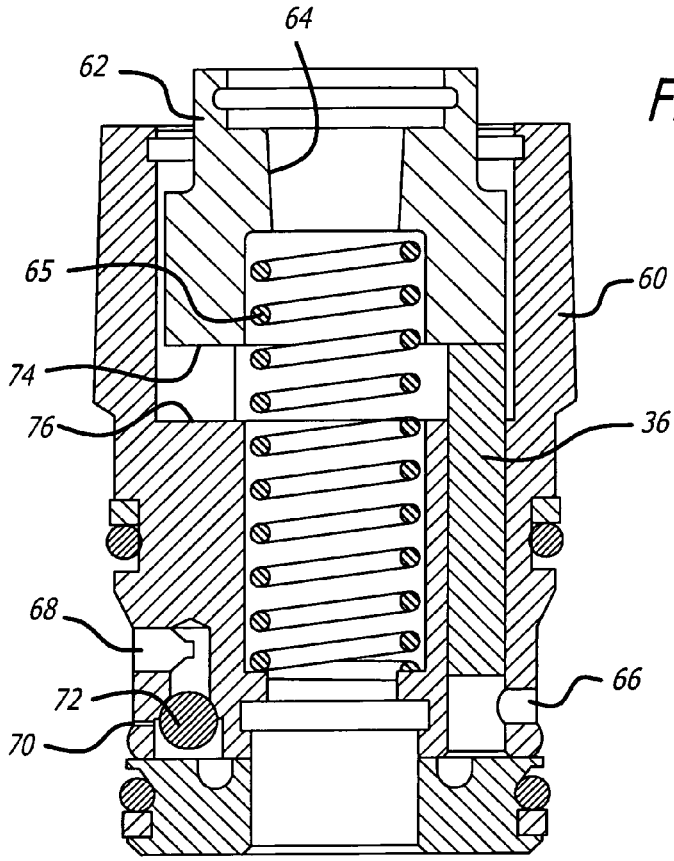
FIG. 3 is a cross section of an exemplary assembly for engine valve return and unidirectional dashpot structure active as an engine valve approaches its full lift.

The hard stop defining the lift allowable by the position of variable position hard stop 42, as well as the dashpots for decelerating an engine valve as it approaches that lift value, is defined for each valve in a preferred embodiment by an assembly such as the assembly of FIG. 3 mounted on variable engine valve lift variable position hard stop 42. As may be seen in FIGS. 1, 2 and 3, pins 36 (3 in a preferred embodiment) operate within body member 60, and act against member 62 having a tapered opening 64 for receipt of the keepers 40 (FIGS. 1 and 2), member 62 being encouraged upward to the engine valve closed position by optional valve closure spring 65. Ports 66, 68 and 70 are coupled to the high pressure rail 26,34. When the engine valve is opening to its maximum lift, pins 36 are forced downward, pumping hydraulic fluid back to the high pressure rail through ports 66 in each pin cylinder and orifice 70, the flow forces forcing ball 72 to seat to close off port 68. However, toward the maximum engine valve lift defined by the position of variable engine valve lift variable position hard stop 42 (FIGS. 1 and 2), pins 36 will start to block ports 66, progressively reducing the flow area from that of the combination of ports 66 and orifice 70 to simply the flow area of orifice 70, thereby providing the dashpot action for decelerating the engine valve to a soft landing at the fixed stop at the maximum lift defined by the position of variable position hard stop 42. In that regard, the fixed stop in this embodiment is provided by the contact of surfaces 74 and 76, which contact just before the pins 36 otherwise would have themselves bottomed out. Of course on coupling the engine valve actuating pistons to the vent or back pressure 33, pressure under pins 36 will decrease, forcing ball 72 downward to open port 68, bypassing the restriction through orifice 70 for rapid acceleration of the engine valve toward the engine valve closed position.

Figure 4:
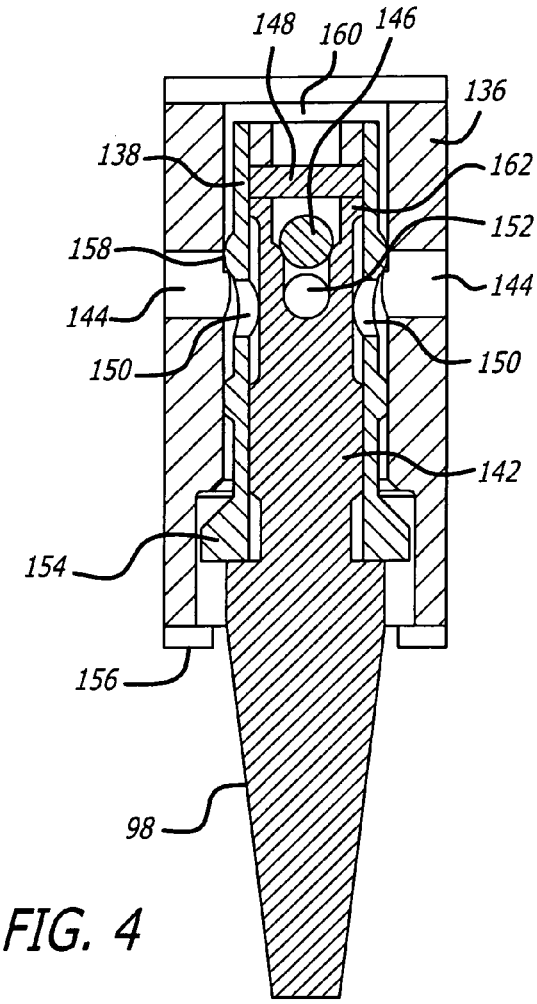
FIG. 4 is a cross section of an exemplary assembly for engine valve actuation using concentric pistons and unidirectional dashpot structure active as an engine valve approaches its closed position.

In a preferred embodiment of the present invention, each engine valve is opened using actuators $\mathbf{22}_1$ through $\mathbf{22}_4$, each having a concentric, dual piston arrangement wherein both pistons are active during initial engine valve opening, after which a single piston continues to push the engine valve to the full open position. For exhaust valves, this helps crack the engine valve open against combustion chamber pressure, and for intake valves, assures a fast engine valve acceleration from the engine valve closed position. In both cases, it conserves hydraulic energy in comparison to using a piston of an area equivalent to the sum of the areas of both pistons for the full engine valve lift. Such a concentric dual piston actuator is shown in FIG. 4. To open the engine valve, the high pressure rail is coupled to ports 144 in body member 136. This couples the high pressure through ports 150 in the boost piston 138 and openings 152 in the drive piston 142, forcing ball 146, retained by pin 148, off the seat to allow free flow of the high pressure hydraulic fluid to the region 160 above a drive piston 142 and the boost piston 138, forcing the combination of the two pistons downward to initiate opening of the engine valve. After initial downward movement of the boost piston 138, land 158 of the boost piston moves downward to also allow flow around the upper part of the boost piston. When flange 154 on the lower end of the boost piston 138 hits stop 156, the boost piston stops moving, though the drive piston 142 continues its downward motion to open the engine valve to its full lift open position, an assembly such as that of FIG. 3 providing both the unidirectional dashpot deceleration of the engine valve as it approaches its full lift, and the hard stop defining the full lift.

For valve closure, ports 144 are coupled to a vent or backpressure rail. Now the drive piston 142 is forced upward by the combined forces of the optional engine valve return spring and the hydraulic return on the engine valve through pins 36 (FIG. 3). Thus the drive piston 142 moves upward through the boost piston 138 until the enlarged portion of the drive piston contacts flange 154 on the boost piston 138 as shown in FIG. 4, after which the boost piston will move upward with the drive piston 142. During the upward motion of the drive piston 142, the pressure differential forces ball 146 onto the seat as shown, blocking flow through port 152. As flange 158 begins to pass ports 144, flow around the upper annulus of the boost piston 138 and then through ports 144 to the vent or back pressure is reduced and is ultimately closed off. The fluid is then forced out of the region 160 above the two pistons through orifice 162, thereby providing the dashpot type deceleration of the assembly, and particularly the engine valve, to a soft landing on closure.

Figure 5:
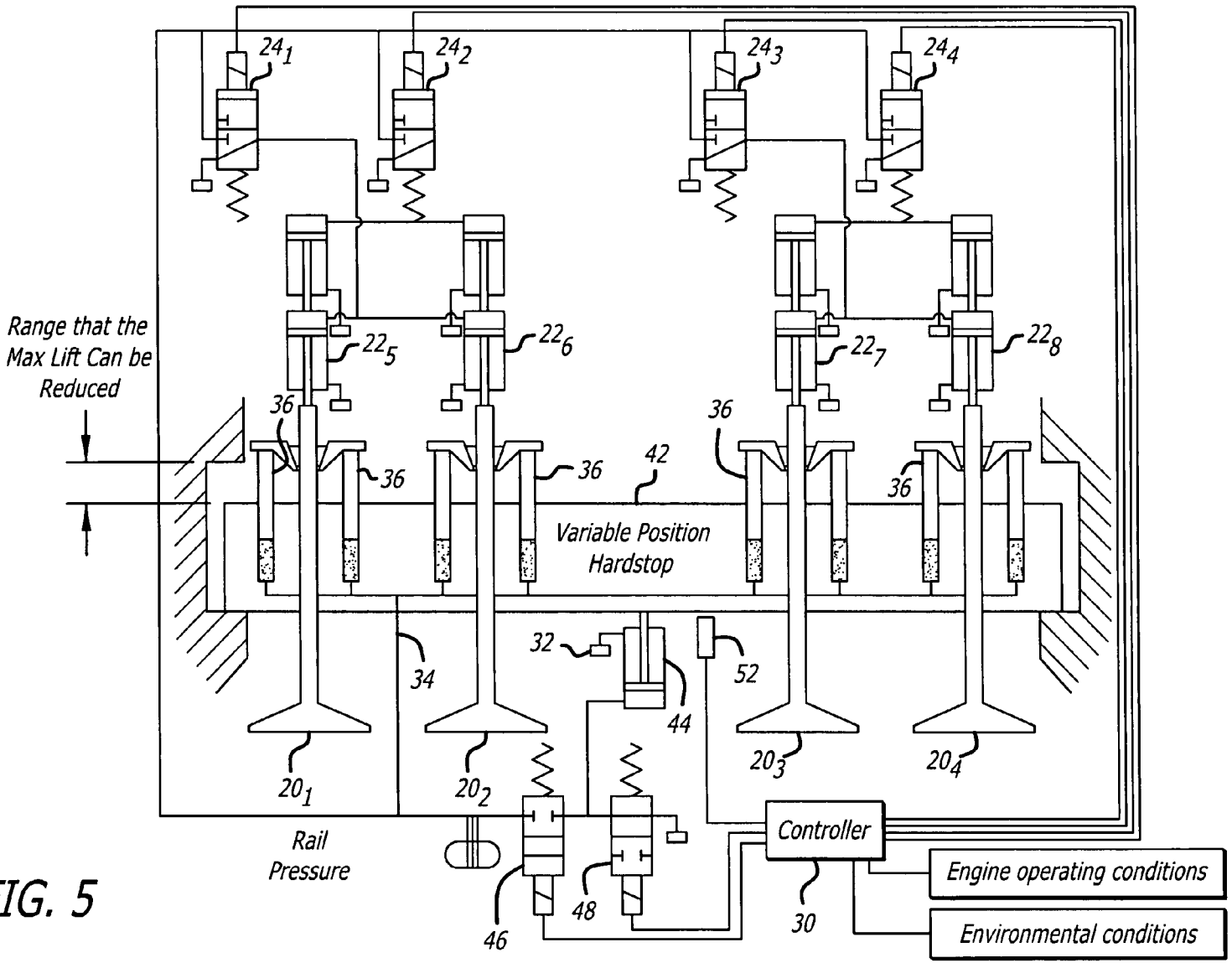
FIG. 5 is a schematic diagram of a still further alternate embodiment of the present invention having a fixed hard stop and a variable hard stop.

Now referring to FIG. 5, a schematic diagram of another embodiment may be seen. This diagram is similar in many respects to the diagrams of FIGS. 1 and 2, though illustrates a hydraulic engine valve actuation system that provides a selection between a first fixed lift and a variable lift. This is useful for such purposes as allowing two different lifts during a single engine cycle. Examples of such uses include exhaust gas recirculation (EGR), where the intake valve(s) are opened slightly during the exhaust stroke, or the exhaust valve(s) are opened slightly during the intake stroke. Opening the valves slightly to a fixed stop for this purpose provides repeatability while allowing a longer open time without excessive recirculation. While in theory, variable position hard stop 42 could be moved for this purpose, the hydraulic energy used could be much higher than one would like. In that regard, in preferred embodiments, the variable position hard stop may be moved between its two extreme positions in 30 to 200 milliseconds, or in approximately one complete engine cycle. Note however, that the position of the variable position hard stop 42 typically only changes when the engine operating conditions change, and then usually by an amount that is substantially less than its maximum possible movement, so that its hydraulic energy consumption is relatively inconsequential.

Figure 6:
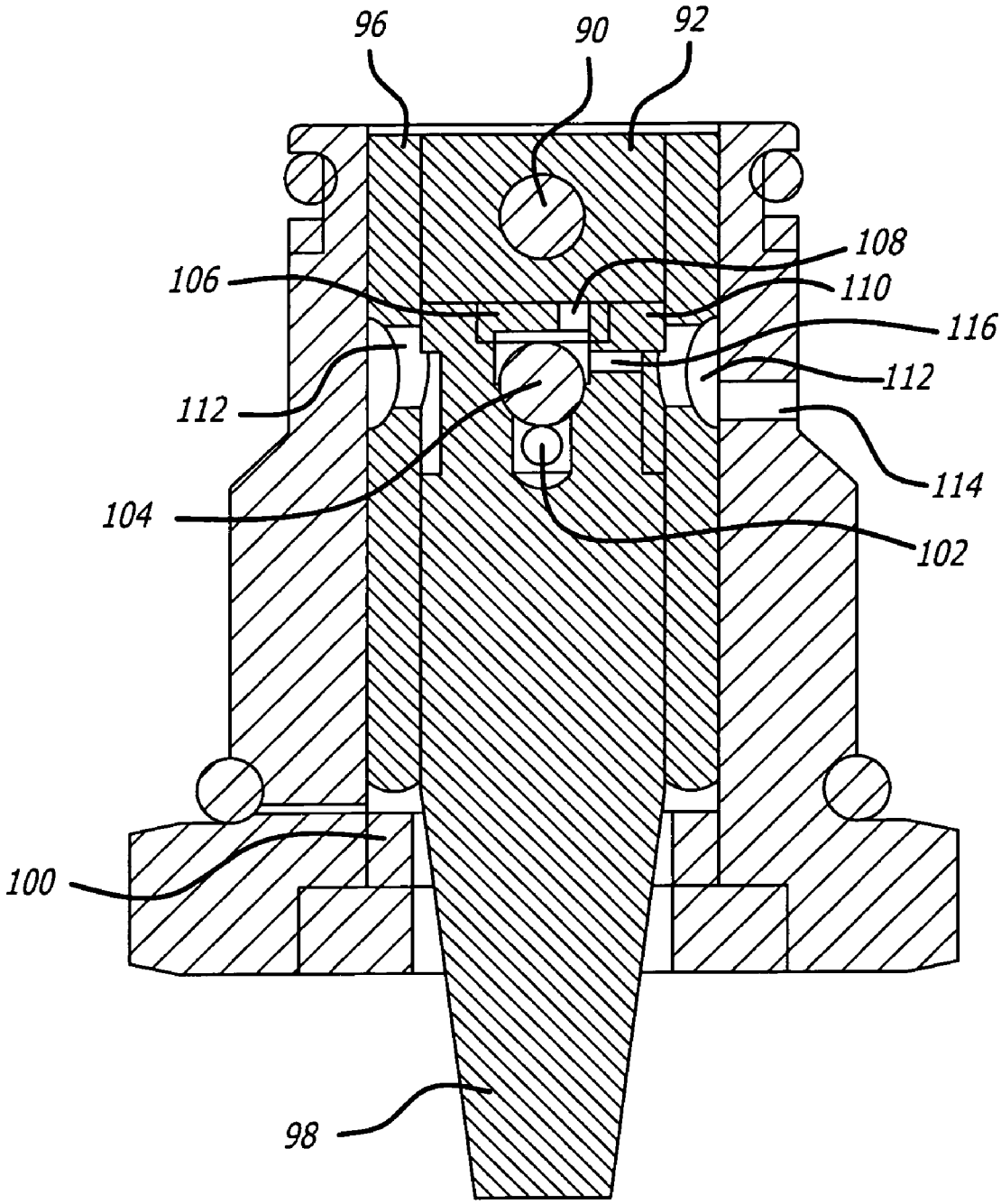
FIG. 6 is a cross section of a concentric piston assembly providing a fixed stop and a second piston extendable to full valve lift.
Figure 7:
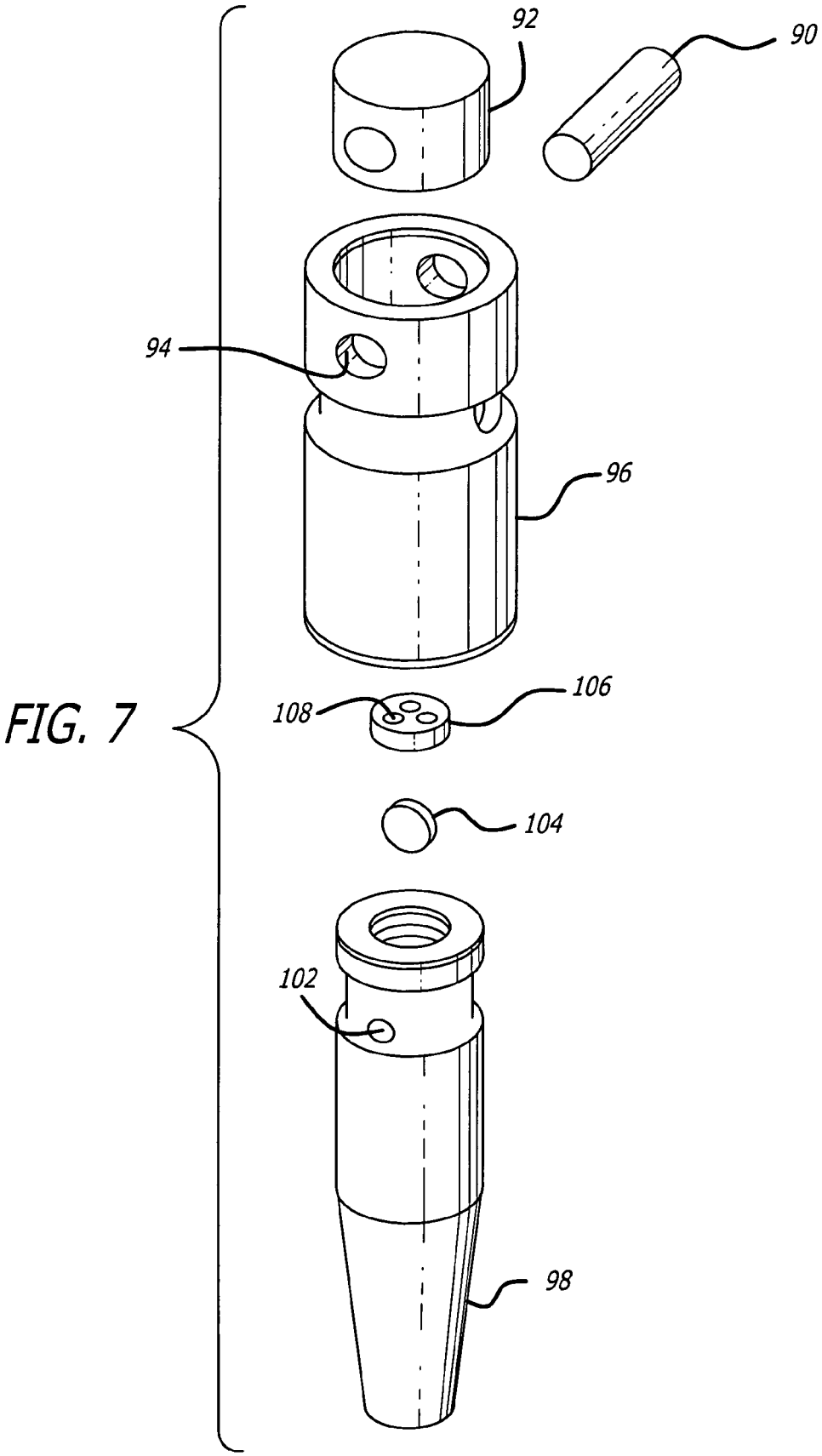
FIG. 7 is an exploded view of the concentric piston assembly of FIG. 6.

In FIG. 5, the position of the variable position hard stop 42 is controlled by controller 30 through valves 46 and 48 as in the embodiments of FIGS. 1 and 2. However the hydraulic actuators $\mathbf{22}_5$ through $\mathbf{22}_8$ differ from the hydraulic actuators $\mathbf{22}_1$ through $\mathbf{22}_4$ of FIG. 1. One embodiment for the actuators $\mathbf{22}_5$ through $\mathbf{22}_8$ is shown in FIGS. 6 and 7, FIG. 6 being a cross-section of the piston assembly and FIG. 7 being an exploded perspective view of the assembly of FIG. 6. As shown in FIGS. 6 and 7, pin 90 extends through plug 92 and holes 94 in piston 96. Thus the plug 92 and piston 96 form a piston of an area equal to the combined area of plug 92 and the annular area of piston 96. When this area is subjected to hydraulic fluid under pressure such as by valve $\mathbf{24}_1$ or $\mathbf{24}_3$, the piston comprised of plug 92 and piston 96 will move member 98, pressing against the top of a valve stem such as on valve stems 25 of FIG. 5, downward until piston 96 bottoms out against fixed stop 100, which sets the fixed lift of the engine valve. For a second, larger lift, a control valve such as control valve $\mathbf{24}_2$ or $\mathbf{24}_4$ of FIG. 5 will apply pressure from the high pressure rail through opening 102. This moves ball 104 upward (FIG. 6) against the check stop 106, having ports 108 therein to allow free hydraulic fluid communication with the top of member 98. This forces member 98 downward with a relatively large stroke, limited in this embodiment by pins such as pins 36 (FIG. 5) and the dashpot arrangement thereof to limit engine valve velocity as it approaches full lift defined by the position of the variable position hard stop 42 and hard stops 74, 76 (FIG. 3).

When the engine valve is to be closed, the respective actuator couples the top of member 98 to port 112 to port 114 to vent or back pressure 33. Now the upward motion of member 98 and the resulting flow forces cause ball 104 to seat as shown in FIG. 6. However, so long as the top edges 110 of member 98 are below openings 112, the hydraulic fluid is free to flow out of port 114. But when the top edge of member 98 moves above port 112, flow is restricted to the orifice 116, forming a dashpot to decelerate member 98 and the closing engine valve to limit the seating velocity of member 98 to member 96. Members 96 and 98 then move together to the final engine valve closed position. Thus ball 104 acts as a check valve.

Now referring again to FIGS. 6 and 7, it is to be noted that the piston providing the shorter engine valve lift comprising piston 96 and plug 92 has a larger hydraulic area than member 98 which provides the greater lift to the engine valve. Such a configuration may have advantages in the case of exhaust valve actuation, in that for the smaller lift, the shorter stroke piston comprising piston 96 and plug 92 may be pressurized, or for the greater lift, the area above member 98 may be pressurized, or both the area over member 98, and the area over piston 96 and plug 92, may be pressurized, depending on engine operating conditions. By way of example, a diesel truck engine may be operating at a substantial rpm but under a light load, in which case the greater valve lift may be desired for better engine aspiration, though because combustion chamber pressures are not as high as they could be, pressurizing the region over member 98 may be adequate for opening the exhaust valves against the remaining combustion chamber pressure. On the other hand, if the same engine is under a heavy load, one might pressurize both regions, gaining the advantage of the greater area of piston 96 and plug 92 to initiate exhaust valve opening against the higher combustion chamber pressure, with the pressure over member 98 continuing to open the engine valve to the greater lift. Consequently, operation of the system may not simply be a question of either/or, but rather, a question of either/or or both, depending on engine operating conditions.

In one embodiment, the system is operated by either pressurizing the region over piston 96 and plug 92 for the shorter lift such as by using valves $\mathbf{24}_1$ and $\mathbf{24}_3$ of FIG. 5, or both the region over piston 96 and plug 92 and the region over member 98 for the larger lift such as by using valves $\mathbf{24}_1$ and $\mathbf{24}_2$, and $\mathbf{24}_3$ and $\mathbf{24}_4$, but not just the region over member 98 alone. While this is not a limitation of the invention, it provides better performance of a specific embodiment, and has the advantage of always providing the maximum initial engine valve opening force. In the embodiment shown, flow to and from the region over member 96 and plug 92 is restricted, though that does not have a great effect in the engine valve opening time because of the relatively short stroke of member 96 and plug 92. Also in one embodiment, the variable position hard stop is controllable to a minimum lift that actually is less than the fixed lift, so in fact even the fixed lift can in fact be reduced if desired. However this is a design choice, not a limitation of the invention, as the fixed lift may in fact be less than the minimum lift achievable by limiting lift by the variable position hard stop 42.

In some applications, it may be desirable to use staged engine valve opening, such as opening an engine valve or valves to one lift, followed by opening to a larger lift before closing, or opening an engine valve or valves to a large lift, then closing somewhat to a smaller lift before closing the engine valve completely.

Figure 8:
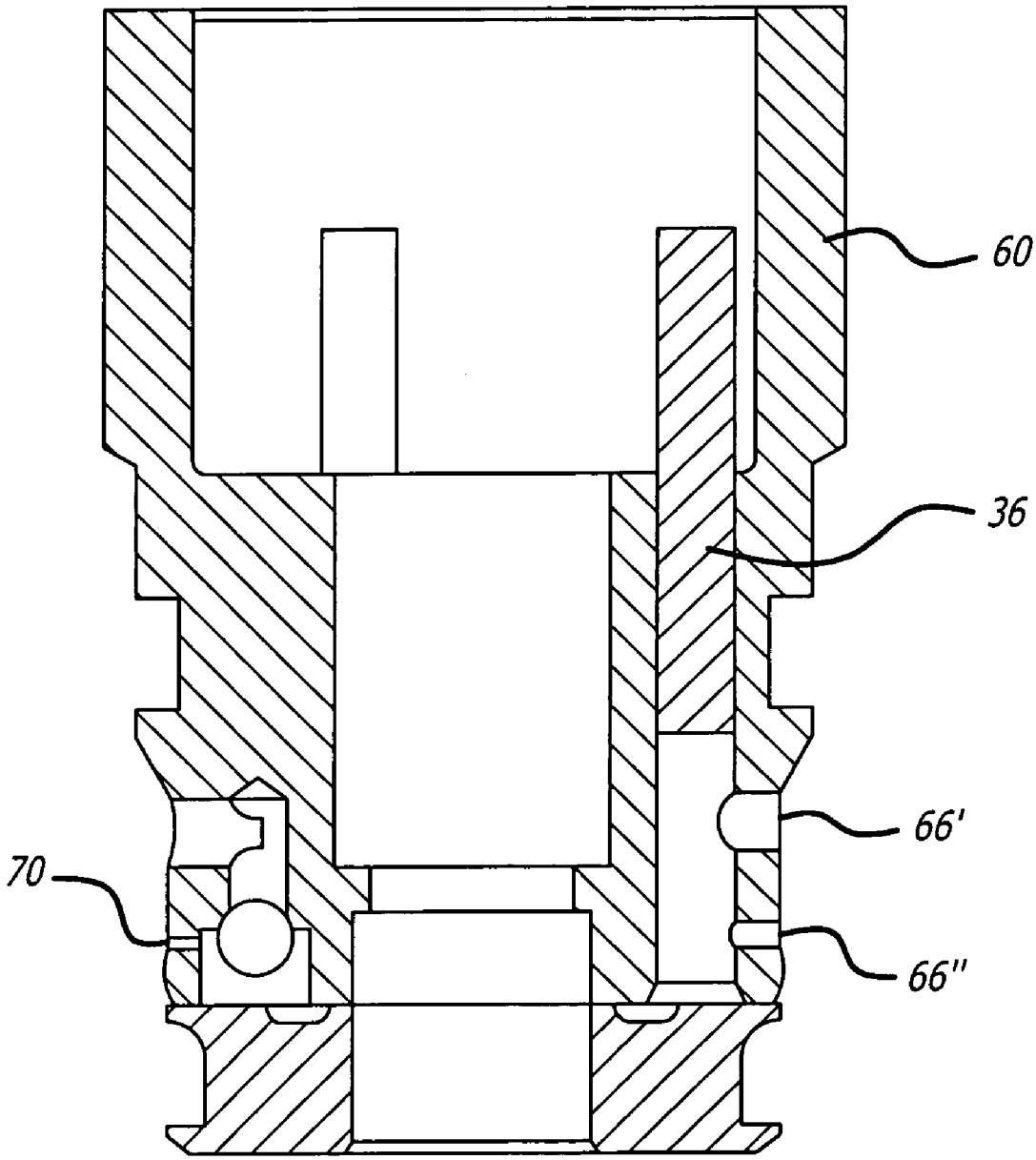
FIG. 8 is a cross section similar to that of FIG. 3, but illustrating a progressive dashpot assembly active as an engine valve approaches full lift.

In the description of FIG. 3, the unidirectional dashpot deceleration of the engine valves as they approach their full lift by pins 36 closing off opening 66, reducing the flow area to that of port 70 only, was described. In another embodiment, member 60 of FIG. 3 is provided with two openings 66' and 66" as shown in FIG. 8 to provide a more gradual reduction in flow area as the engine valves approach their full lift. Thus using this technique, one can shape the deceleration profile of the engine valves as desired. Obviously one could use a vertical slot or shaped slot for the deceleration curve shaping, though for manufacturing reasons, drilled holes are preferred. Also, while the two holes 66' and 66" are shown one above the other, they could be associated with different pins 36, i.e., distributed around the periphery of member 60, facilitating the possible overlap of the holes in terms of vertical separation without difficulty. Actually, with three pins 36, three different sized holes plus port 70 could be used, simulating a shaped slot without the manufacturing difficulties of actually providing a shaped slot. However, using only two holes 66' and 66" plus port 70 has been found to provide progressive orifices with very good shaping. In one embodiment, port 66' is open up to 6 mm from full lift, port 66" is open up to 0.7 mm from full lift.

Figure 9:
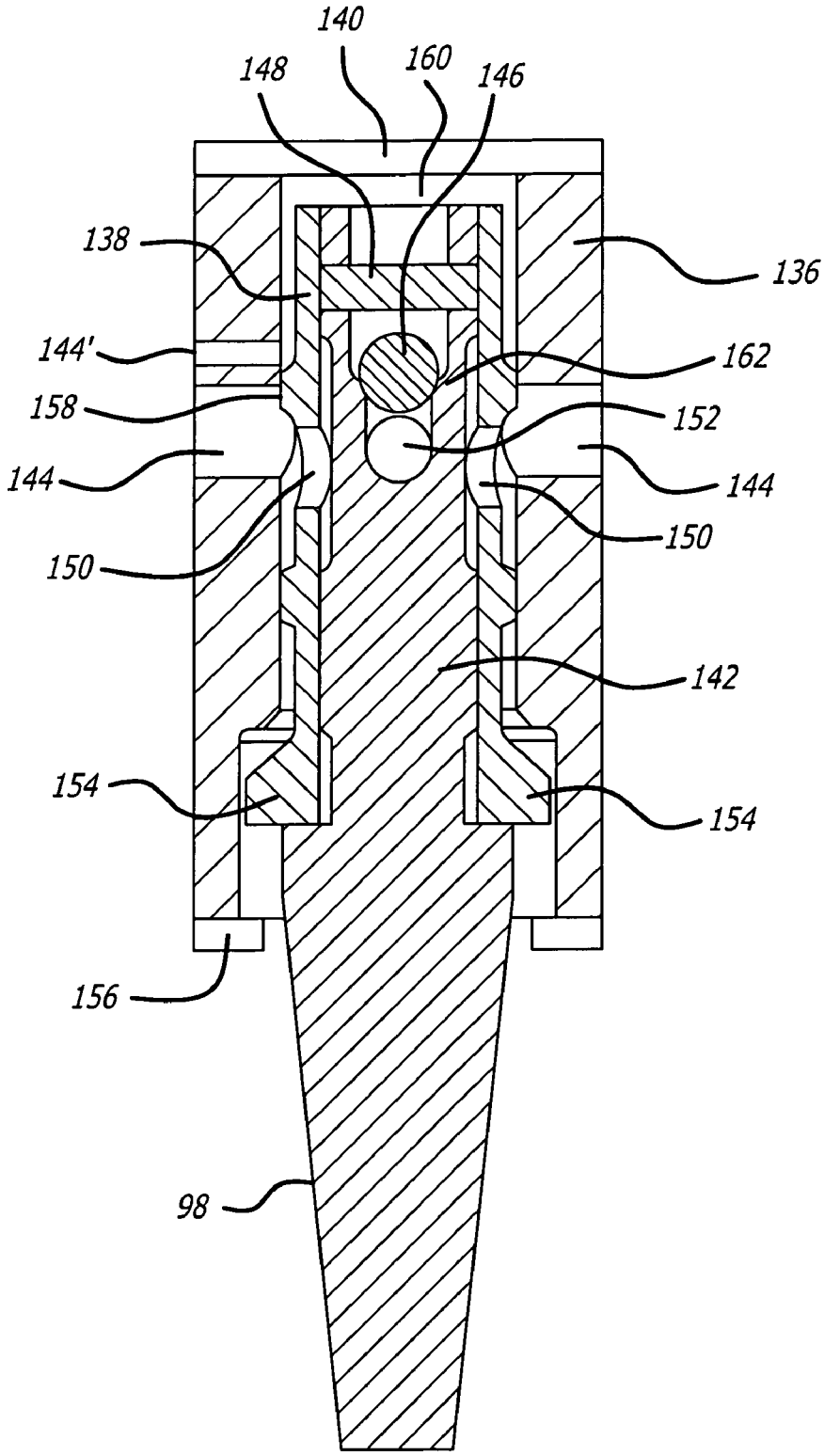
FIG. 9 is a cross section similar to that of FIG. 4, but illustrating a progressive dashpot assembly active during engine valve closing.

The same progressive orifice concepts can be applied to the unidirectional dashpots active on valve closure. By way of example, an additional port 144' can be added to the assembly of FIG. 4, as shown on FIG. 9. While the port shown is relatively small, obviously the port size and proportions, as well as the number of additional ports, can be selected as desired to get the desired deceleration shaping.

Figure 10:
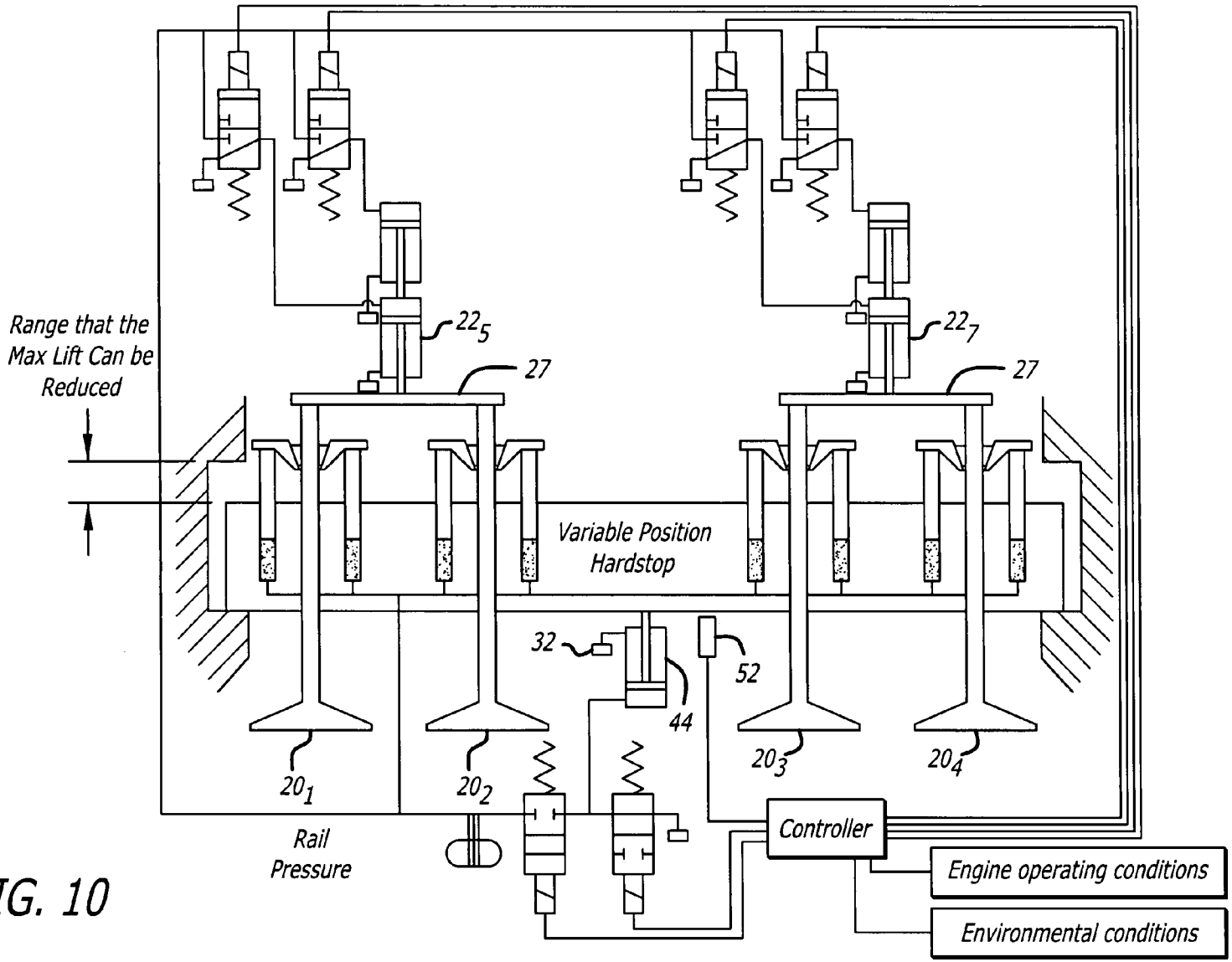
FIG. 10 is a schematic diagram of an embodiment similar that of FIG. 5, but with each hydraulic actuator controlling two engine valves through the use of a mechanical bridge.

Now referring to FIG. 10, an embodiment functionally substantially the same as that of FIG. 5 may be seen. However in this embodiment, actuators $\mathbf{22}_5$ and $\mathbf{22}_7$ each control engine valves $\mathbf{20}_1$ and $\mathbf{20}_2$, and $\mathbf{20}_3$ and $\mathbf{20}_4$, respectively, through mechanical bridges 27. In that regard, the mechanical bridge may take various forms, such as by way of one example, rocker arms, one spanning the valve stems of intake valves $\mathbf{20}_1$ and $\mathbf{20}_2$ of a given cylinder and the other spanning the valve stems of exhaust valves $\mathbf{20}_3$ and $\mathbf{20}_4$ of the same cylinder. The mechanical bridge reduces the number of actuators 22 that are needed and may better synchronize the motion of the engine valves.

Figure 11:
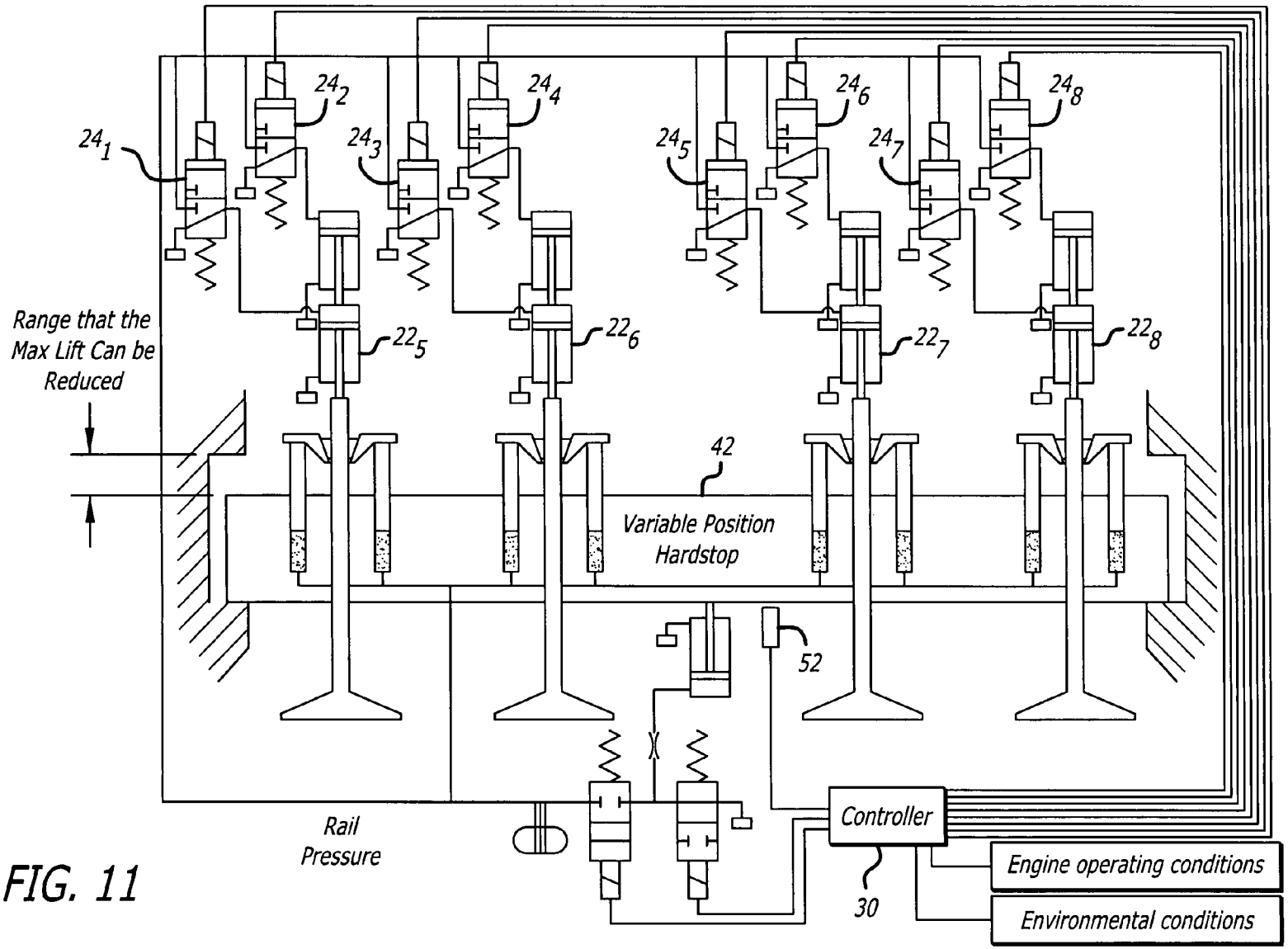
FIG. 11 is a schematic diagram of an embodiment similar that of FIG. 5, but with each hydraulic actuator being controlled by its own pair of control valves.

FIG. 11 is similar to FIG. 5, though each actuator $\mathbf{22}_5$ through $\mathbf{22}_8$ is controlled by its own pair of control valves $\mathbf{24}_1$ and $\mathbf{24}_2$, $\mathbf{24}_3$ and $\mathbf{24}_4$, $\mathbf{24}_5$ and $\mathbf{24}_6$, and $\mathbf{24}_7$ and $\mathbf{24}_8$, respectively, using a hydraulic actuator 22 of the type shown in FIG. 6. Using two control valves per actuator allows each valve to be controlled to have a small lift by pressurizing the region over piston 96 and plug 92 (FIG. 6) or a higher lift controlled by the variable position of variable position hard stop 42 and the pressurization of the region over member 98 (FIG. 6 again). The four valves shown in FIG. 11 might be, by way of example, an intake and an exhaust valve for two cylinders, or two intake valves and two exhaust valves for one cylinder, or one intake valve or one exhaust valve for four cylinders. In that regard, in various embodiments herein, four engine valves are shown, though this is symbolic only, as a single variable position hard stop may control the lift of as few as one engine valve, as in the embodiment of FIGS. 12 and 13, to more than four engine valves, and/or intake valves or exhaust valves for more than four cylinders of an engine.

In the embodiment of FIG. 11, position sensor 52 is shown connected to controller 30 to provide variable position control for variable position hard stop 42, generally controlling the greater lift, though as mentioned before in one embodiment, the various parameters were chosen so that variable position hard stop 42 in its uppermost position would even limit the lower lift provided by hydraulic actuators 22. As another method of operating such a system, however, hydraulic actuators 22 might provide one fixed lift and variable position hard stop 42, by moving between its two extreme positions, providing two additional fixed lifts. By way of example, hydraulic actuators 22 might provide a relatively small lift when the region over piston 96 and plug 92 (FIG. 6) is pressurized, with the variable position hard stop 42 providing two additional and different greater lifts when the region over member 98 is also pressurized, dependent upon which extreme position variable position hard stop 42 is in. Such an arrangement provides a good selection of lifts for various engine operating conditions and environmental conditions, and has an advantage of simplicity in that the position sensor 52 is not required, and the system may be operated open loop, reducing the control requirements.

Figure 12:
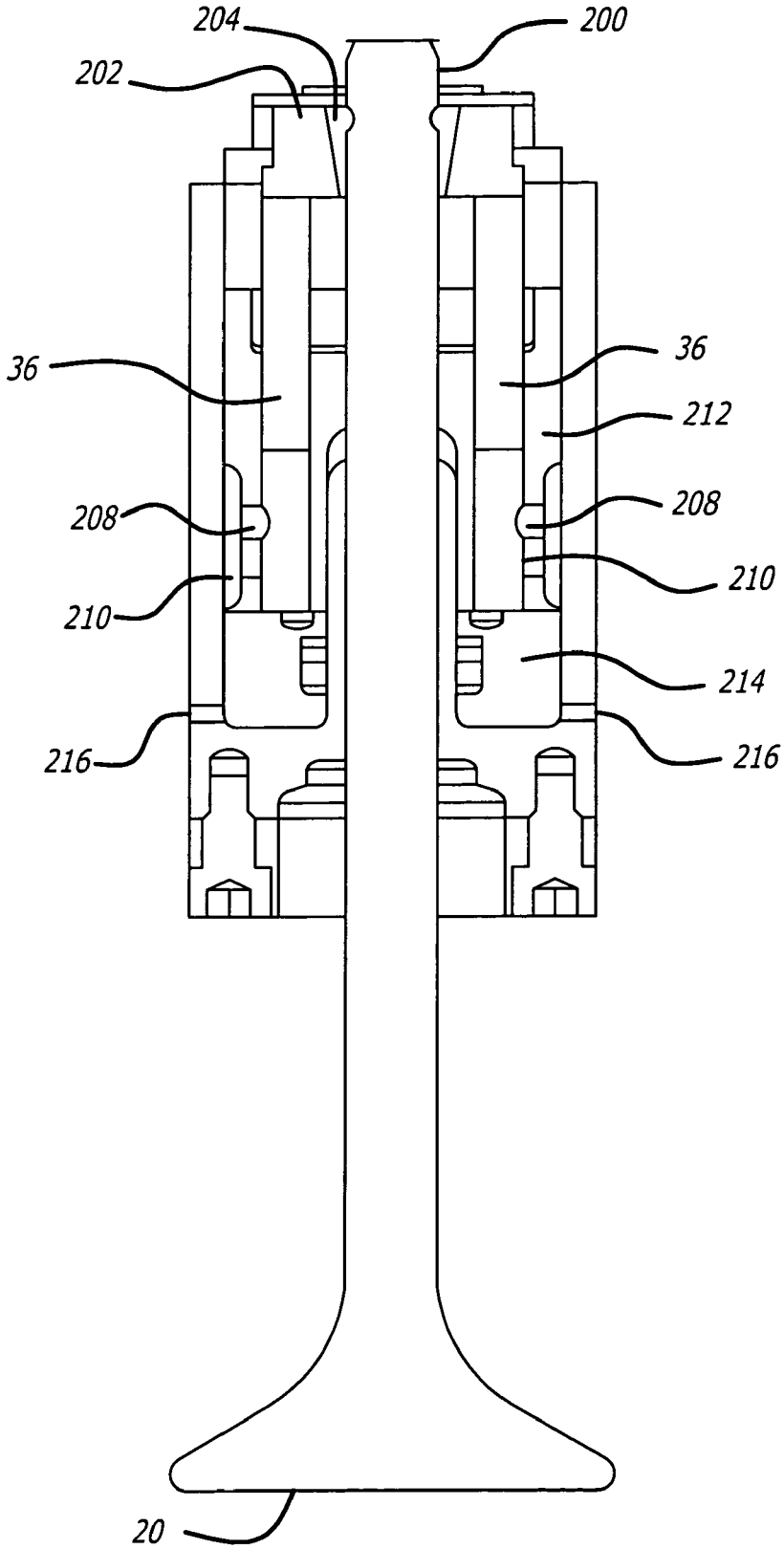
FIG. 12 is a cross section through part of an integrated engine valve actuation module with a variable lift hard stop.
Figure 13:
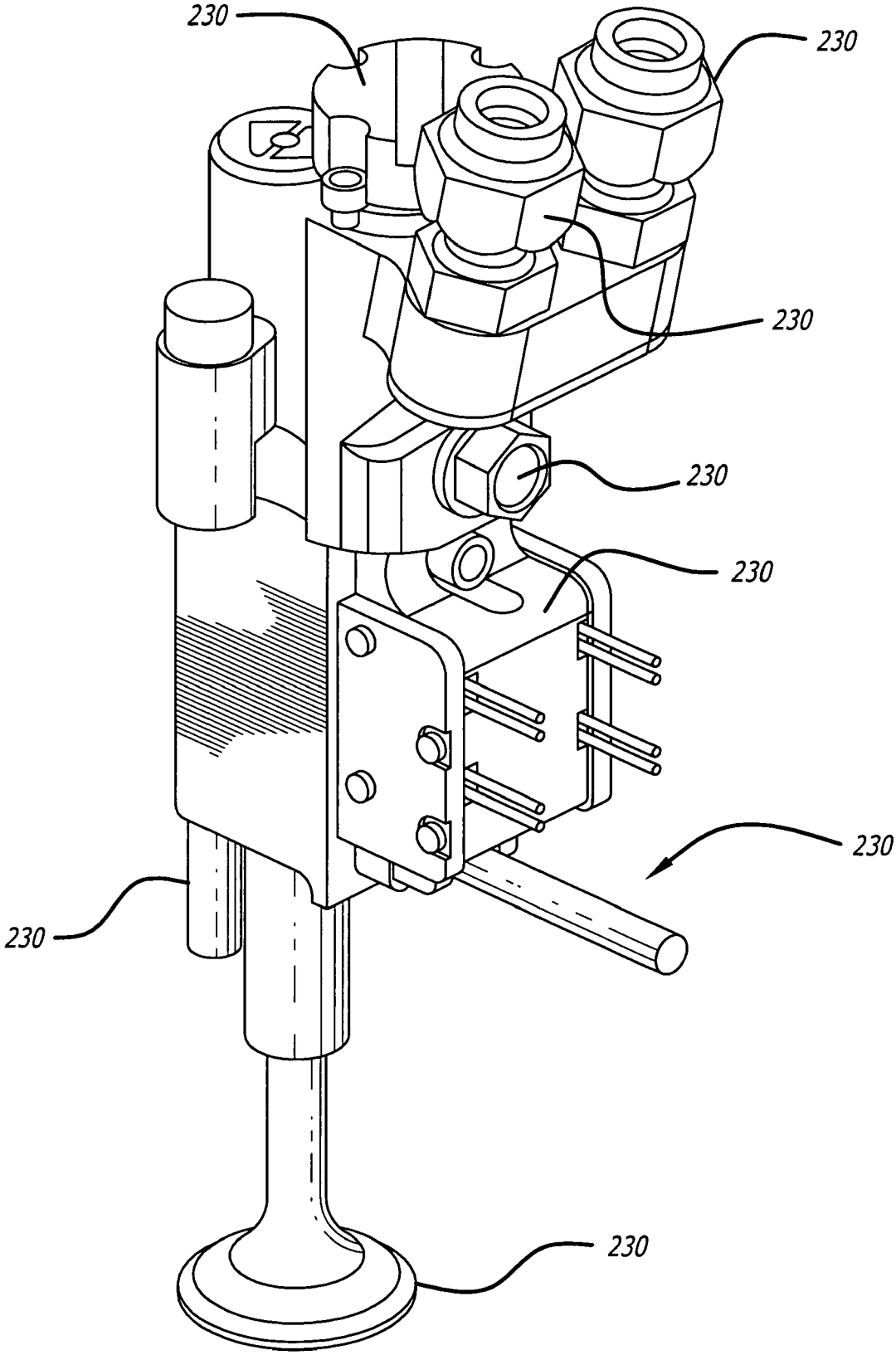
FIG. 13 is a perspective view of the entire module of FIG. 12.

In the embodiments hereinbefore disclosed, a moveable fixed stop variable position hard stop 42 provides a variable hard stop for a plurality of valves. This, however, is not a limitation of the present invention, as the same concepts may be applied to a single engine valve such as is shown in FIGS. 12 and 13. Here a single engine valve 20 is controlled by an engine valve actuation module (FIG. 13) that includes not only the hydraulic actuators, but also the control valves for the hydraulic actuators.

FIG. 12 is a cross section through part of the module of FIG. 13 showing aspects of the hydraulic system and variable lift hard stop. As shown in FIG. 12, valve stem 200 is retained relative to member 202 by keepers 204. Pins 36 have rail pressure applied to their bottom surfaces through openings 208 and 210, which function as progressive orifices as described with respect to openings 66' and 66' in FIG. 8. In that regard, the check valve comprising ball 72 of FIG. 3 may also be incorporated if desired, though is not shown in this cross-section. In FIG. 12, member 212, brazed to member 214 and within which pins 36 operate, is vertically moveable with stop member 214, shown in its lowermost position, but which may be raised by applying rail pressure through ports 216 by a two-way valve or lowered by coupling ports 216 to a low pressure or vent through another two-way valve. Positioned above valve stem 200 in the module of FIG. 13 is a hydraulic actuator like that shown in FIG. 4, the lower tapered end of member 142 cooperating with a Hall effect sensor 220 (FIG. 13) in the module. Also visible in the module, in addition to engine valve 20, is the two-position three-way valve 222, in the preferred embodiment a single coil, spring return spool valve, the two two-way valves 224 controlling the position of the variable position hard stop member 214, the rail and back pressure or vent connections 226 for the engine valve actuator, and drain, generally indicated by the numeral 228. The module shown in FIG. 13 may be used as a universal module, in that through the use of appropriate adapters, the module itself may be bolted to such adapters by bolts 230, making the module particularly well suited for experimental use on a variety of engines.

While certain preferred embodiments of the present invention have been disclosed and described herein for purposes of illustration and not for purposes of limitation, it will be understood by those skilled in the art that various changes in form and detail may be made therein without departing from the spirit and scope of the invention.

What is claimed is:

1. An engine valve actuation system comprising:

in a camless engine;

a first actuator configured to actuate an engine valve between an engine valve closed position and engine valve open positions;

a second actuator moveable between first and second positions, when in the first position the second actuator being configured to define a stop limiting the engine valve opening to a first lift, and when in the second position the second actuator being configured to define a stop limiting the engine valve opening to a second lift different from the first lift, the first and second actuators being hydraulic actuators; and, said camless engine having a unidirectional dashpot operative in a single direction only, and limiting engine valve velocity as the engine valve approaches either of the first and second lifts.

2. The system of claim 1 further comprised of a sensor for providing a signal indicative of the position of the second actuator.

3. The system of claim 2 wherein the sensor provides a signal responsive to the position of an engine valve.

4. The system of claim 2 wherein the sensor provides a signal responsive to the position of the second actuator.

5. The system of claim 2 wherein the second actuator may be positioned at positions ranging from the first to the second position responsive to an output of the sensor to define lifts between the first and second lift, the unidirectional dashpot limiting engine valve velocity as the engine valve approaches any lift defined by the second actuator.

6. The system of claim 1 wherein the second actuator defines stops to limit the lift of multiple engine valves.

7. The system of claim 6 wherein the multiple engine valves include intake and exhaust valves for a single cylinder of an engine.

8. The system of claim 6 wherein the multiple engine valves include intake valves for multiple cylinders of an engine.

9. The system of claim 6 wherein the multiple engine valves include exhaust valves for multiple cylinders of an engine.

10. The system of claim 6 wherein the second actuator defines stops for multiple engine valves and further comprised of multiple unidirectional dashpots limiting multiple engine valve velocities as the engine valves approach any lift defined by the second actuator.

11. The system of claim 1 wherein the first actuator includes first and second pistons, the first piston having a stroke defining a third engine valve lift different from the first and second engine valve lifts, the second piston having a stroke at least equal to the larger of the first and second engine valve lifts.

12. The system of claim 11 further comprised of electromagnetically actuated control valving to selectively pressurize the first and second pistons.

13. The system of claim 1 further comprised of electromagnetically actuated control valving coupled to control a plurality of first actuators, and wherein each first actuator is configured to actuate at least one engine valve between an engine valve closed position and engine valve open positions.

14. The system of claim 1 wherein the second actuator defines stops to limit the lift of multiple engine valves, and further comprised of a position sensor indicative of the lift of the engine valves.

15. The system of claim 14 wherein the position sensor is configured to sense the position of the second actuator.

16. The system of claim 14 further comprised of a control system responsive to the position sensor to position the second actuator at positions ranging from the first to the second position.

17. The system of claim 1 wherein the first actuator is configured to actuate a plurality of engine valves between an engine valve closed position and engine valve open positions.

18. A hydraulic engine valve actuation system comprising:

in a camless engine:

a first hydraulic actuator configured to actuate an engine valve between an engine valve closed position and engine valve open positions;

a second hydraulic actuator moveable between first and second positions, when in the first position the second actuator being configured to define a stop limiting the engine valve opening to a first lift, and when in the second position the second actuator being configured to define a stop limiting the engine valve opening to a second lift different from the first lift, said camless engine having a unidirectional dashpot, operative in a single direction only, associated at least in part with the second hydraulic actuator and configured to limit engine valve velocity as the engine valve approaches either of the first and second lifts.

19. The system of claim 18 further comprised of a sensor for providing a signal indicative of the position of the second actuator.

20. The system of claim 19 wherein the sensor provides a signal responsive to the position of an engine valve.

21. The system of claim 19 wherein the sensor provides a signal responsive to the position of the second actuator.

22. The system of claim 19 wherein the second actuator may be positioned at positions ranging from the first to the second position responsive to an output of the sensor to define lifts between the first and second lifts, the unidirectional dashpot limiting engine valve velocity as the engine valve approaches any lift defined by the second actuator.

23. The system of claim 22 wherein the first actuator includes first and second pistons, the first piston having a stroke defining a third engine valve lift different from the first arid second engine valve lifts, the second piston having a stroke at least equal to the larger of the first and second engine valve lifts.

24. The system of claim 23 further comprised of electromagnetically actuated control valving to selectively pressurize the first and second pistons.

25. The system of claim 18 wherein the second actuator defines stops to limit the lift of multiple engine valves.

26. The system of claim 25 wherein the multiple engine valves include intake and exhaust valves for a single cylinder of an engine.

27. The system of claim 25 wherein the multiple engine valves include intake valves for multiple cylinders of an engine.

28. The system of claim 25 wherein the multiple engine valves include exhaust valves for multiple cylinders of an engine.

29. The system of claim 18 wherein the first actuator includes first and second pistons, the first piston having a stroke defining a third engine valve lift different from the first and second engine valve lifts, the second piston having a stroke at least equal to the larger of the first and second engine valve lifts.

30. The system of claim 29 further comprised of electromagnetically actuated control valving to selectively pressurize the first and second pistons.

31. The system of claim 18 wherein the second actuator defines stops to limit the lift of multiple engine valves, and further comprised of a position sensor indicative of the lift of the engine valves.

32. The system of claim 31 wherein the position sensor is configured to sense the position of the second actuator.

33. The system of claim 31 further comprised of a control system responsive to the position sensor to position the second actuator at positions ranging, from the first to the second position responsive to an output of the sensor.

34. The system of claim 18 further comprised of electromagnetically actuated control valving coupled to control a plurality of first actuators, and wherein each first actuator is configured to actuate at least one engine valve between an engine valve closed position and engine valve open positions.

35. The system of claim 18 wherein the first actuator is configured to actuate a plurality of engine valves between an engine valve closed position and engine valve open positions.

36. The system of claim 22 wherein the second actuator defines stops for multiple engine valves and further comprised of multiple unidirectional dashpots limiting multiple engine valve velocities as the engine valves approach a lift defined by the second actuator.

* * * * *